United States Patent [19]

Cunningham

[11] Patent Number: 4,919,260

[45] Date of Patent: Apr. 24, 1990

[54] PACKAGE UNIT OF CAN-TYPE CONTAINERS

[75] Inventor: Ernest R. Cunningham, Libertyville, Ill.

[73] Assignee: Grip-Pak, Inc., Deerfield, Ill.

[21] Appl. No.: 309,328

[22] Filed: Feb. 10, 1988

[51] Int. Cl.[5] ..... B65D 71/02

[52] U.S. Cl. ..... 206/150; 206/158; 206/199; 206/144

[58] Field of Search ..... 206/150, 162, 427, 199, 206/158, 161, 144, 428

[56] References Cited

U.S. PATENT DOCUMENTS

| | | | |
|---|---|---|---|
| 2,341,570 | 2/1944 | Reachi | 206/144 |
| 2,677,460 | 5/1954 | Johnson et al. | 206/162 |
| 3,206,019 | 9/1965 | Curry, Jr. et al. | 206/161 |
| 3,383,827 | 5/1968 | Schaich | 206/158 |
| 3,422,564 | 1/1969 | Izumi | 206/427 |
| 3,733,100 | 5/1973 | Tranzer | 430/456 |
| 3,734,278 | 5/1973 | Kerrican et al. | 206/144 |
| 3,959,949 | 6/1976 | Benno et al. | 53/48 |
| 4,018,331 | 4/1977 | Klygis | 206/199 |
| 4,079,571 | 3/1978 | Schlueter et al. | 53/48 |
| 4,121,712 | 10/1978 | Cunningham | 206/158 |
| 4,219,117 | 8/1980 | Weaver et al. | 206/150 |
| 4,269,308 | 5/1981 | Platt | 206/150 |
| 4,385,690 | 5/1983 | Olsen | 206/150 |
| 4,385,691 | 5/1983 | Klygis | 206/150 |
| 4,462,494 | 7/1984 | Cunningham | 206/150 |
| 4,471,010 | 9/1984 | McBriarty | 206/150 |
| 4,487,312 | 12/1984 | Heider | 206/158 |
| 4,685,565 | 8/1987 | Sparling | 206/427 |

FOREIGN PATENT DOCUMENTS

| | | | |
|---|---|---|---|
| 0703197 | 4/1966 | Italy | 206/144 |

*Primary Examiner*—Paul T. Sewell
*Assistant Examiner*—David Jenny
*Attorney, Agent, or Firm*—McAndrews, Held & Malloy Ltd.

[57] ABSTRACT

A package unit having a plurality of can-type containers. A pair of plastic strips each comprising eight container circling bands are elastically received by the containers. A single row of containers receives both plastic strips for connecting the containers in a twelve pack arrangement.

5 Claims, 2 Drawing Sheets

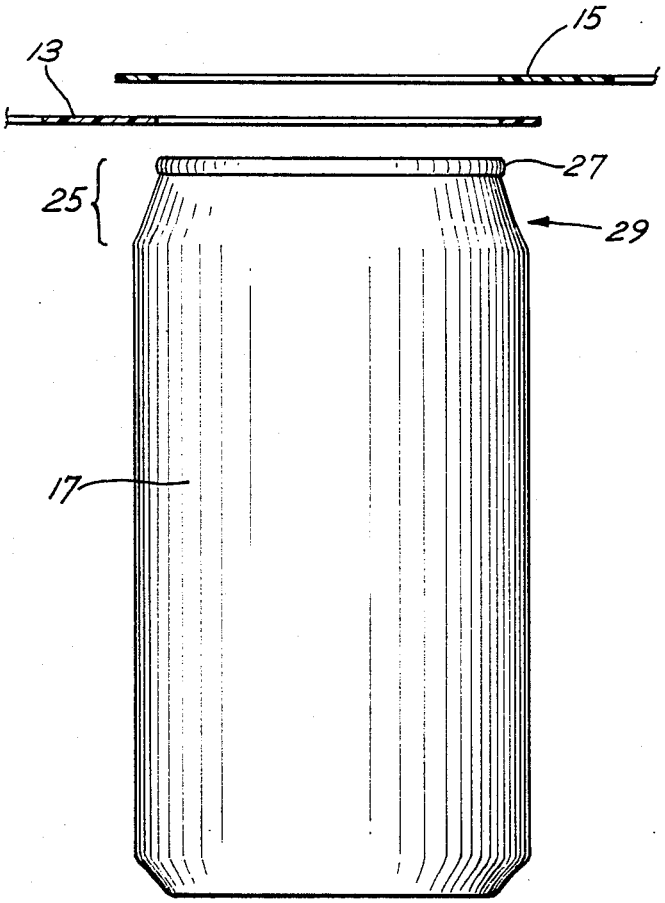
Fig. 3
Fig. 4
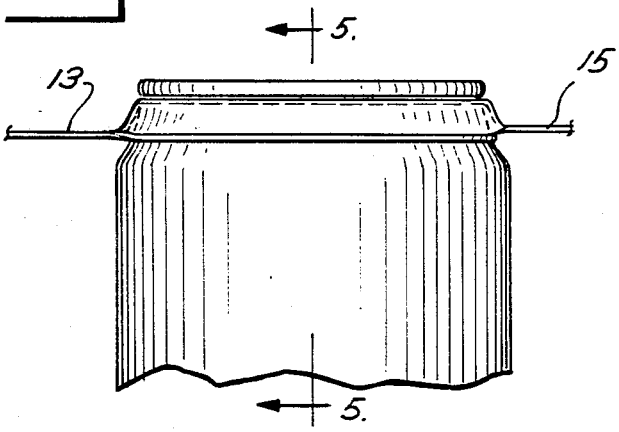
Fig. 5
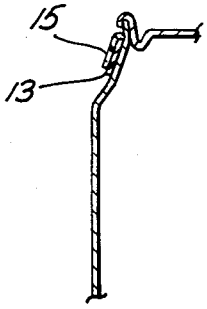

PACKAGE UNIT OF CAN-TYPE CONTAINERS

BACKGROUND OF THE INVENTION

The invention relates to a multipackage for a plurality of can-type containers, and more particularly to the use of a plurality of interacting discrete plastic sheets of uniform thickness for securing a plurality of cylindrical containers in a single supporting/carrying unit.

Heretofore, a single thin plastic strip is machine applied to the tops of a number of containers arranged in pairs to secure the containers together for carrying as a single package. The plastic strip is formed from a resilient, elastomeric plastic material of substantially uniform thickness. The strip includes a plurality of apertures which are enlarged to form encircling bands. The number of encircling bands equals the number of containers to be assembled into a single multipackage. For example, U.S. Pat. No. 4,462,494, assigned to the assignee of the present invention, illustrates non-circular apertures formed in the plastic strip. Uniform longitudinal and lateral spacing exists between the encircling bands and convenient finger holes may be provided in the plastic strip for enabling the carrying of the assembled package as a discrete unit.

While such prior strip carriers have been found convenient and advantageous for packaging containers numbering 2, 4, 6 and 8, a package unit for a large number of containers, such as 9, 12 or 15, using a larger plastic strip to form the carrier, results in an unwieldy array of containers. Because of the leverage forces generated on the single strip by the weight of the containers when a 12-container array is carried, individual containers become loosened or dislodged from the plastic strip. The carrier strips are designed to permit easy removal of cans for consumption; however, the forces generated by a twelve-pack of containers, as is illustrated in U.S. Pat. No. 4,079,571, for example, frequently results in the release of containers by the mere act of picking up and carrying the unit.

To avoid this problem, the prior art has taught the use of an additional "belly-band" around the central region of the outside of the 12-pack in order to compensate for the forces generated during pickup and carrying. As shown in U.S. Pat. No. 4,269,308, a plastic belly-band is used in conjunction with a single plastic strip across the top of the containers. The belly-band includes a handle to permit carrying of the package unit without producing a force which would tend to dislodge any container from the plastic strip secured across the top of containers.

However, a belly-band type arrangement requires the additional cost of the plastic belly-band as well as the need for specialized, single source machinery to install the belly-band. Further, the user must remove the belly-band before removing a single container from the package. And once the band has been removed, the package integrity is destroyed and cannot be moved about without reinstating the problems previously alleviated by the belly-band.

It is therefore an object of the present invention to provide an improved carrier which eliminates the need of a separate belly-band to restrain the forces working on the containers during the action of pick up and carrying the package about.

It is yet another object of the invention to provide a 12-pack carrier which overcomes the problems of carrying forces which tend to loosen or dislodge individual containers from the package.

It is still another object of the present invention to provide a single design carrier that's adaptable for a plurality of 3, 6, 9, 12 and 15 containers, which is able to be manufactured and applied to cans without the need for completely different type of production equipment or assembly machines.

It is also an object of the present invention to provide a strip carrier for a plurality of containers, which is easily carryable without the loss of a can from the carrier.

SUMMARY OF THE INVENTION

These and other objects of the invention are achieved in the use of a pair of plastic strip devices engaging in overlapping disposition the top portion of a plurality of arrayed containers. A plurality of can-type containers are arranged in an array of rows and ranks. A first discrete packaging device resiliently engages a first group of containers and a second discrete packaging device resiliently engages a second group of containers. A number of containers forming part of both the first and second group and are resiliently engaged by both the first and the second discrete packaging devices.

BRIEF DESCRIPTION OF THE DRAWINGS

FIG. 3 is a exploded side view of a container and the two discrete packaging devices of FIG. 2. FIG. 4 is a side view of a container resiliently connected to the two discrete packaging devices of FIG. 2. FIG. 5 is a cut-away side view of the container of FIG. 4.

DESCRIPTION OF THE PREFERRED EMBODIMENT

Figure 1:
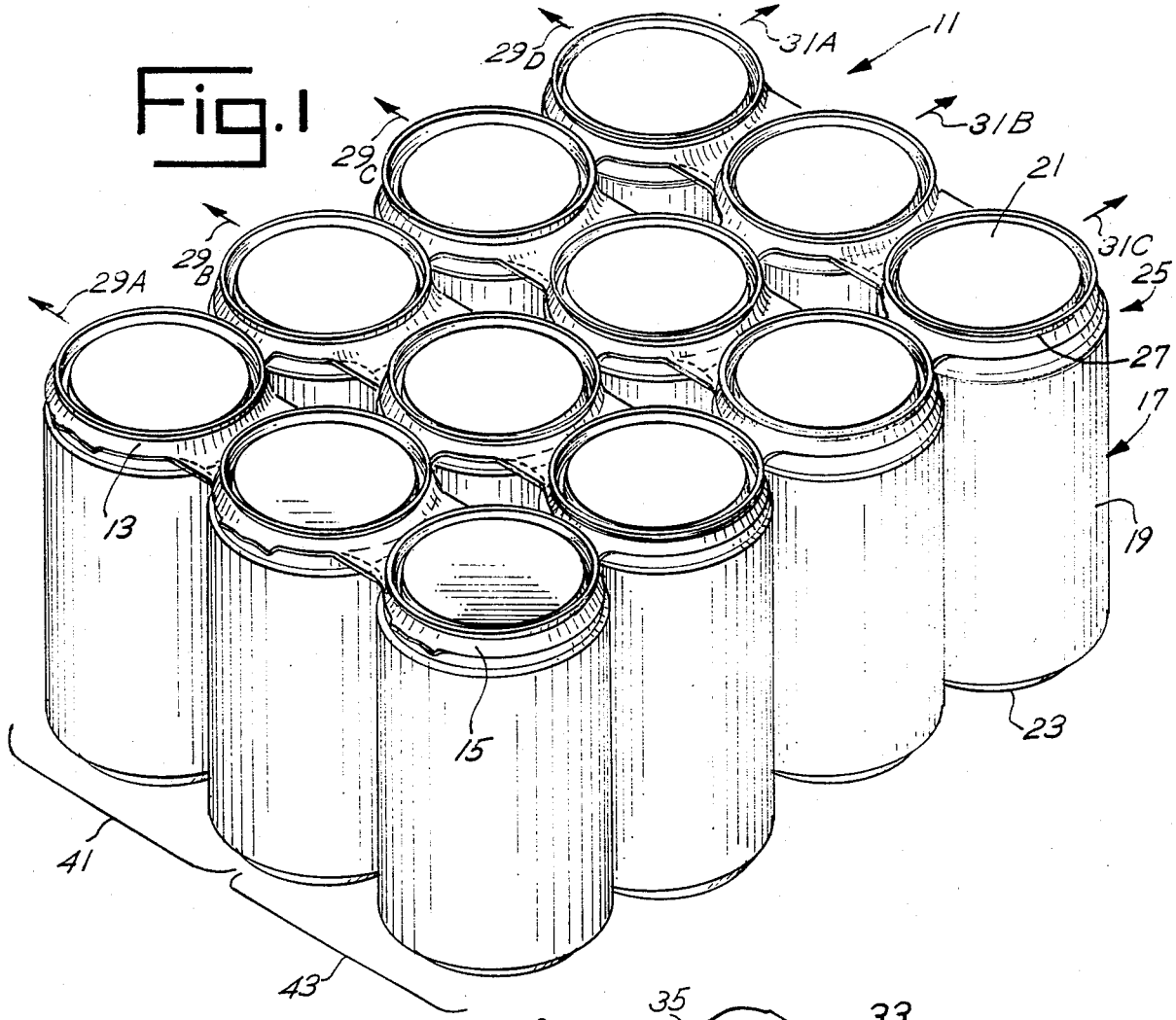
FIG. 1 is a perspective view of a carrier embodiment of the present invention.

Referring to FIG. 1, a carrier 11 includes a pair of overlapping packaging devices 13,15 which receives a plurality of containers 17 to form a single package unit. Containers 17 are of the can-type variety having a cylindrical side wall 19, a top wall or lid 21 and a bottom 23.

As shown in FIG. 3, a top portion 25 of each container 17 is formed with a perimeter lip 27 and a necked region 29 disposed subjacent to the perimeter lip. The top portion 25 provides an area for resilient engagement of a packaging device 13,15.

As shown in FIG. 1, containers 17 are twelve in number although the principle is applicable to assembly of 3, 6, 9, 12 and 15 containers. The twelve containers are arranged in an array of three rows 31A, 31B, 31C and four ranks 29A, 29B, 29C, 29D, i.e., a $3\times4$ array. The containers are held in spaced-apart uniform relation by overlapping packaging devices 13,15.

Figure 2:
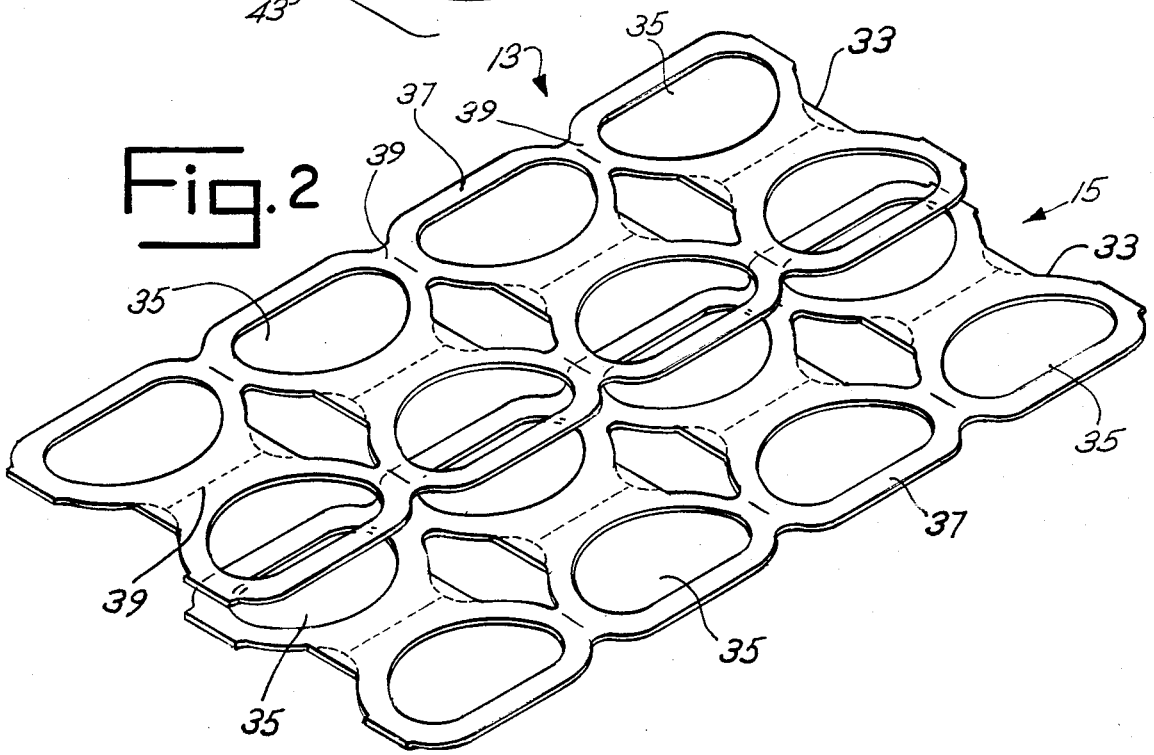
FIG. 2 is a perspective view of two discrete packaging devices of the carrier of FIG. 1.

Referring to FIG. 2, each packaging device 13,15 is alike. Each is formed from a strip 33 of thermoplastic, typically low density polyethylene, having a substantially uniform thickness of approximately 0.016 inches. The industry standard is 0.016 inches, but the present invention permits the use of a thinner thermoplastic strip. Preferably, the strip is between 0.01 and 0.03 inches.

Each strip 33 has four pairs of apertures 35 each formed by container encircling bands 37 which are interconnected by web regions 39. Apertures 35 are smaller in circumference than the top portions 25 of the containers where the encircling bands resiliently engage the containers. An example of such a packaging device is shown in U.S. Pat. No. 4,462,494, incorporated herein by reference, which is owned by the same assignee of the present invention.

The first packaging device 13 has its eight encircling bands 37 arrayed in two rows and four ranks. As shown in FIG. 1, each encircling band of device 13 elastically receives the top portion of a respective one of a first group 41 of the containers. The first group is formed of eight containers arrayed in two (2) rows 31A, 31B and four (4) ranks 29A–D. Thus, packaging device 13 connects together only eight of the twelve containers.

The second packaging device 15 has its eight encircling bands 37 arrayed in two rows and four ranks. As shown in FIG. 1, each encircling band of device 15 elastically receives the top portion of a respective one of a second group 43 of the containers. The second group is formed of eight containers arrayed in two (2) rows 31B, 31C of four (4) ranks 29A–D. Thus, packaging device 15 connects together only eight of the twelve containers.

One of the rows of containers of the first group 41 is a row of containers of the second group 43. The one row of containers which forms a part of both the first and second group of containers is the middle row 31B and receives encircling bands from both plastic packaging devices 13,15. Thus, plastic packaging devices 13,15 overlap along the middle row of containers in the 3×4 array. As shown in FIGS. 4 and 5, each encircling band of the second packaging device 15 which engages the containers of the middle row partially rests atop the encircling band of the first packaging device 13.

The middle row 31B of containers serves to support its adjacent row 31A or 31C by the web portions interconnecting the bands of each packaging device 13,15. Because each packaging device is a discrete unit, the forces on one packaging device do not directly affect the containers engaged by the other packaging device. During carrying motion, the carrier ;1 moves with respect to two planes, each plane being defined by a respective packaging device 13,15.

As will suggest itself, the preferred embodiment is directed to a twelve container carrier. The teaching of the invention may also be applied to fifteen container array (3×5), a nine container array (3×3), a six container array (3×2) and a three container array (3×1), although, as mentioned above, the prior use of a single packaging strip device suffices for a six container array.

While only a single, preferred embodiment of the invention has been described hereinabove, those of ordinary skill in the art will recognize that that embodiment may be modified and altered without departing from the central spirit and scope of the invention. Thus, the preferred embodiment described hereinabove is to be considered in all respects as illustrative and not restrictive, the scope of the invention being indicated by the appended claims, rather than by the foregoing description, and all changes which come within the meaning and range of equivalency of the claims are intended to be embraced herein.

What is claimed is:

1. A package unit comprising: twelve cylindrical containers arranged in an array of three rows and four ranks, each of said containers having a top portion with a perimeter lip of a predetermined diameter; a first discrete packaging device formed of a resilient strip of plastic material of uniform thickness, said strip comprising eight container encircling bands arranged in a connected series of two rows and four ranks, each of said encircling bands elastically receiving the top portion below the perimeter lip of a respective one of a first group of eight of said containers for connecting together two adjacent rows of containers; and a second discrete packaging device formed of a resilient strip of plastic material of uniform thickness, said strip comprised of eight container encircling bands arranged in a connected series of two rows and four ranks, each of four of said encircling bands of one row of said second discrete packaging device elastically receiving the top portion of a respective one of four containers of one row of said first group of eight containers and each of the other four of said encircling bands of the other row of said second group elastically receiving the top portion below the perimeter lip of a respective one of a second group of one row of four of said containers.

2. A package unit according to claim 1 wherein said uniform thickness of said first and second discrete packaging devices is 0.01 to 0.03 inches.

3. A package unit according to claim 2 wherein said first and second discrete packaging devices are formed from an elastomeric sheet material.

4. A package unit according to claim 3 wherein said sheet material is polyethylene.

5. A package unit comprising: a plurality of cylindrical containers arranged in an array of rows and ranks, each of said containers having a top portion with a perimeter lip of a predetermined diameter; a first discrete packaging device formed of a resilient strip of plastic material of uniform thickness, said strip comprising a plurality of container encircling bands arranged in a connected series of rows and ranks, each of said encircling bands elastically receiving the top portion below the perimeter lip of a respective one of a first group of a plurality of said containers for connecting together adjacent rows of containers; and a second discrete packaging device formed of a resilient strip of plastic material of uniform thickness, said strip comprised of a plurality of container encircling bands arranged in a connected series of rows and ranks, each of said encircling bands of one row of said second discrete packaging device elastically receiving the top portion of a respective one of containers of one row of said first group of containers and each of the other of said encircling bands of another row of said second group elastically receiving the top portion below the perimeter lip of a respective one of a second group of said containers.

* * * * *